US010932053B2

(12) United States Patent
Linghu et al.

(10) Patent No.: US 10,932,053 B2
(45) Date of Patent: Feb. 23, 2021

(54) SPEAKER WITH ELASTIC SUPPORT MEMBER AND METHOD FOR MANUFACTURING THE SAME

(71) Applicant: AAC Technologies Pte. Ltd., Singapore (SG)

(72) Inventors: Ronglin Linghu, Shenzhen (CN); Bo Xiao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,072

(22) Filed: Jul. 28, 2019

(65) Prior Publication Data

US 2020/0045457 A1 Feb. 6, 2020

(30) Foreign Application Priority Data

Aug. 6, 2018 (CN) ..... 201810886984.6

(51) Int. Cl.
*H04R 7/20* (2006.01)
*H04R 31/00* (2006.01)
(Continued)

(52) U.S. Cl.
CPC ..... *H04R 9/06* (2013.01); *H04R 1/021* (2013.01); *H04R 7/20* (2013.01); *H04R 31/003* (2013.01);
(Continued)

(58) Field of Classification Search
CPC . H04R 9/00; H04R 9/04; H04R 9/041; H04R 9/043; H04R 9/045; H04R 7/16;
(Continued)

(56) References Cited

U.S. PATENT DOCUMENTS 9,813,821 B1 * 11/2017 Song ..... H04R 9/06
2002/0043424 A1 * 4/2002 Tomiyama ..... H04R 9/043 181/172

(Continued)

FOREIGN PATENT DOCUMENTS

CN 205491130 B1 8/2016
CN 207251908 B1 4/2018
CN 207560323 B1 6/2018

OTHER PUBLICATIONS

1st Office Action dated Aug. 27, 2020 by SIPO in related Chinese Patent Application No. 201810886984.6 (6 Pages).

*Primary Examiner* — Walter F Briney, III
(74) *Attorney, Agent, or Firm* — W&G Law Group LLP

(57) ABSTRACT

A speaker and a method for manufacturing the speaker are provided. The speaker includes: a vibration unit; a magnetic circuit unit; and a housing for receiving the vibration unit and the magnetic circuit unit. The vibration unit includes: a first diaphragm fixed to the housing; a voice coil arranged under the first diaphragm to drive the first diaphragm to vibrate and emit sound; and an elastic support member arranged under the voice coil, fixed to the housing and elastically supporting the voice coil. The elastic support member includes a flexible circuit board connected to the voice coil and a second diaphragm fixed under the flexible circuit board. The housing includes a holder, the elastic support member is fixed to the holder, and the flexible circuit board is attached and fixed to the second diaphragm.

6 Claims, 5 Drawing Sheets

(51) Int. Cl.
*H04R 9/06* (2006.01)
*H04R 1/02* (2006.01)

(52) U.S. Cl.
CPC .... *H04R 2307/207* (2013.01); *H04R 2400/11* (2013.01); *H04R 2499/11* (2013.01)

(58) Field of Classification Search
CPC ... H04R 7/18; H04R 7/20; H04R 7/24; H04R 7/26; H04R 31/003; H04R 2209/024; H04R 2231/00; H04R 2231/001; H04R 2231/003; H04R 2307/201; H04R 2307/204; H04R 2307/207; H04R 2400/07; H04R 2499/11
See application file for complete search history.

(56) References Cited

U.S. PATENT DOCUMENTS

| | | | | |
|---|---|---|---|---|
| 2016/0057543 | A1* | 2/2016 | Salvatti | H04R 9/043 381/398 |
| 2017/0184052 | A1* | 6/2017 | Lineton | B32B 15/16 |

* cited by examiner

SPEAKER WITH ELASTIC SUPPORT MEMBER AND METHOD FOR MANUFACTURING THE SAME

TECHNICAL FIELD

The present disclosure relates to the field of electric-acoustic conversion technologies, and in particular, to a speaker and a method for manufacturing the same.

BACKGROUND

A flexible printed circuit board (FPC board) is formed by combining an insulating substrate such as a flexible polyester membrane or polyimide with a circuit etching on a copper foil, and has high reliability and excellent flexibility. It can be freely bent, wound and folded, can be arbitrarily arranged according to spatial layout requirements, and can be arbitrarily moved and stretched in a three-dimensional space, thereby achieving integration of component assembly and wire connection. The use of the FPC board can greatly reduce the volume of the speaker, and is suitable for the development of the speaker in the direction of high density, miniaturization, and high reliability. Therefore, FPC boards have been widely used in fields of aerospace, military, mobile communications, laptop computers, computer peripherals, handheld computers, and digital cameras or other products.

In the related art, a flexible circuit board is located under a voice membrane. When the speaker is working, there is a phase difference between the voice membrane suspension and the force arm of the flexible circuit board, so that the voice membrane suspension may interfere with the force arm of the flexible circuit board, thereby producing noise.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
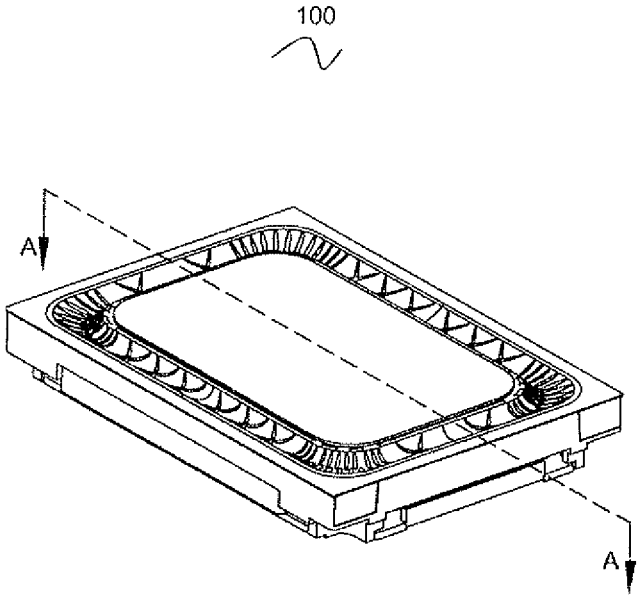
FIG. 1 is a perspective view of a speaker according to an embodiment of the present disclosure.

The present disclosure will be further described in detail below with reference to the accompanying drawings FIGS. 1-7 in order to better understand the technical solutions of the present disclosure and the advantages thereof. In the following examples, the following embodiments are provided to facilitate a clearer understanding of the present disclosure and not to limit the present disclosure. The expressions indicating the orientations such as up, down, left, and right are only for positions of the illustrated structures in the corresponding drawings.

As shown in FIGS. 1-5, in a first aspect of the present disclosure, a speaker 100 is provided. The speaker 100 includes a vibration unit 110, a magnetic circuit unit 120, and a housing 130 for receiving the vibration unit 110 and the magnetic circuit unit 120. The vibration unit 110 includes a first diaphragm 111 fixed to the housing 130, a voice coil 112 arranged under the first diaphragm 111 to drive the first diaphragm 111 to vibrate, and an elastic support member 113 arranged under the voice coil 112, fixed to the housing 130 and elastically supporting the voice coil 112. The elastic support member 113 includes a flexible circuit board 113*a* connected to the voice coil 112, and a second diaphragm 113*b* fixed under the flexible circuit board 113*a*. The housing 130 includes a holder 131. The elastic support member 113 is fixed to the holder 131. The flexible circuit board 113*a* is attached and fixed to the second diaphragm 113*b*.

With the speaker 100 in this embodiment, the elastic support member 113 includes a flexible circuit board 113*a* connected to the voice coil 112, and a second diaphragm 113*b* fixed under the flexible circuit board 113*a*, the elastic support member 113 is fixed to the holder 131, and the flexible circuit board 113*a* is attached and fixed to the second diaphragm 113*b*. In this embodiment, the flexible circuit board 113*a* and the second diaphragm 113*b* are attached and fixed to be formed into one piece. In this way, when the height of the speaker 100 is constant, the vibration space of the second diaphragm 113*b* can be saved and the Xmax range of the product can be improved, thus reducing the assembly process while improving the pure tone yield of the product.

In one embodiment, the flexible circuit board 113*a* can be attached with the second diaphragm 113*b* into one piece by a thermosetting adhesive, that is, when the elastic support member 113 is being manufactured, an outer surface of the flexible circuit board 113*a* may be coated with the thermosetting adhesive. The second diaphragm 113*b* is then placed on the flexible circuit board 113*a*. The coated thermosetting adhesive can be used to glue the flexible circuit board 113*a* and the second diaphragm 113*b* into one piece when the second diaphragm 113*b* is thermoformed, so that the manufacturing process of the elastic support member 113 can be simplified, the manufacturing cost can be reduced, and the economic benefit can be improved.

Of course, in addition to attaching flexible circuit board 113*a* with the second diaphragm 113*b* into one piece by the thermosetting adhesive, other bonding methods can be also adopted in the elastic support member 113.

Figure 2:
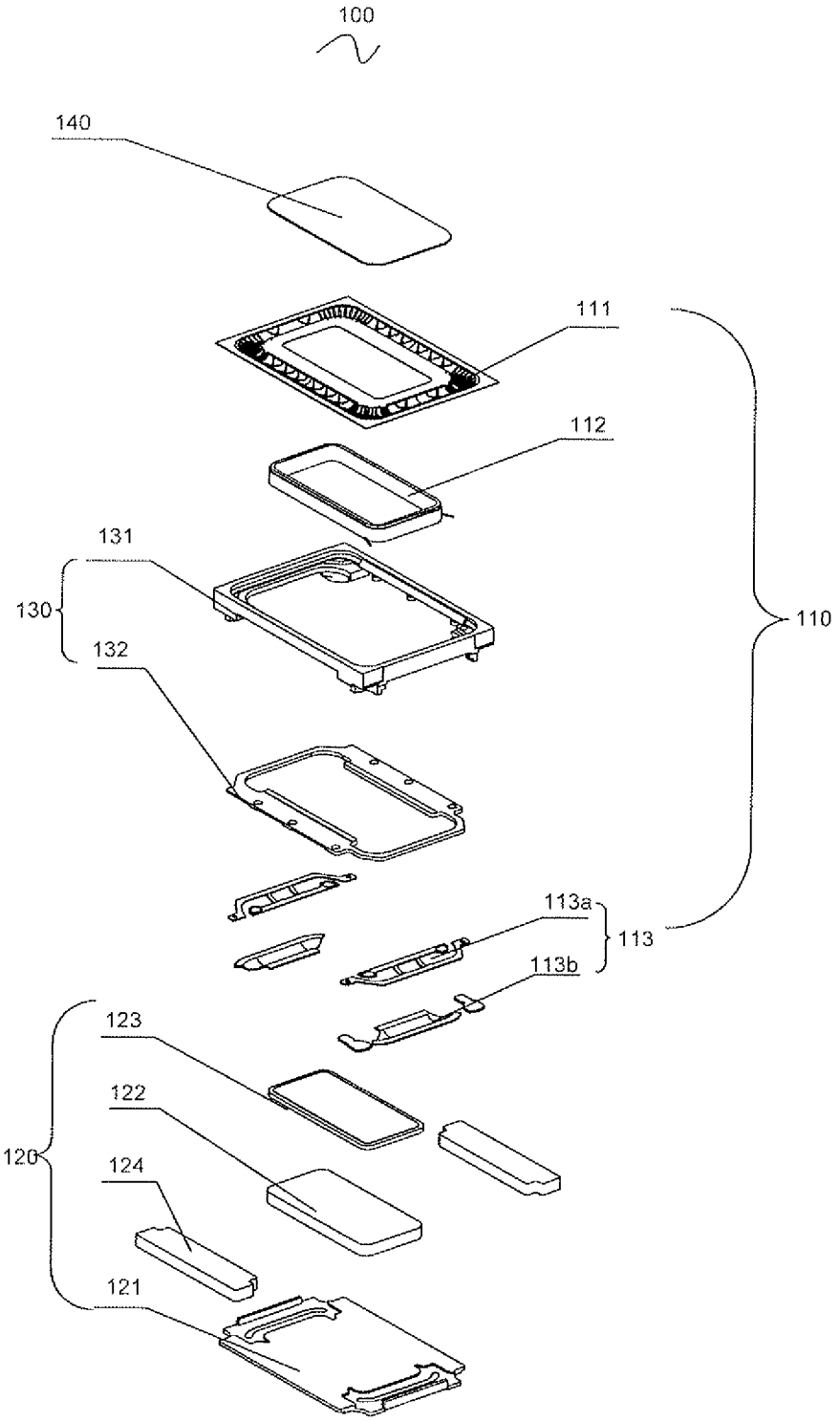
FIG. 2 is an exploded view of a speaker according to an embodiment of the present disclosure.
Figure 6:
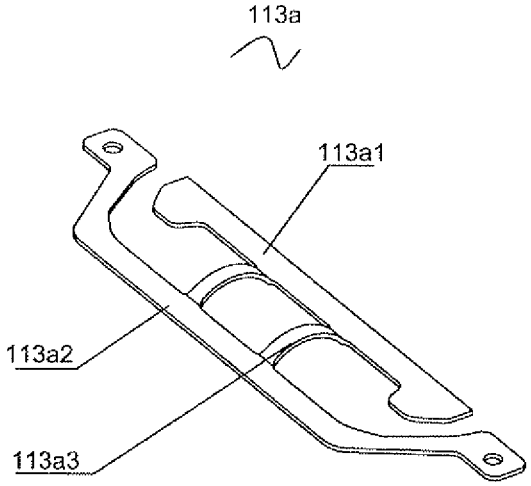
FIG. 6 is a perspective view of a flexible circuit board according to an embodiment of the present disclosure.

As shown in FIGS. 2 and 6, the flexible circuit board 113*a* includes a first inner edge 113*a*1 glued to the voice coil 112, a first outer edge 113*a*2 glued to the holder 131, and a beam 113*a* connecting the first inner edge 113*a*1 with the first outer edge 113*a*2. The provided beam 113*a*3 may serve to conduct the voice coil 112 with an external flexible circuit board.

Figure 7:
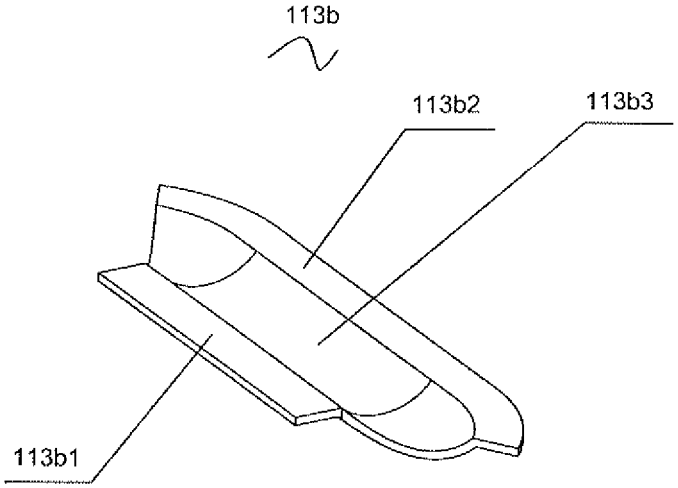
FIG. 7 is a perspective view of a second diaphragm according to an embodiment of the present disclosure.

As shown in FIGS. 2 and 7, the second diaphragm 113*b* includes a second inner edge 113*b*1 attached and fixed to the first inner edge 113*a*1, a second outer edge 113*b*2 attached and fixed to the first outer edge 113*a*2, and the suspension portion 113*b*3 connecting the second inner edge 113*b*1 with the second outer edge 113b2. The suspension portion 113b3 and the beam 113a3 are attached and fixed to each other. With the speaker 100 provided by the present embodiment, the suspension portion 113b3 is attached and fixed to the beam 113a3, so that it is possible to effectively solve the pure sound problem caused by the mutual impact between the suspension portion 113b3 and the beam 113a3 when the existing product is vibrated, thereby enhancing the sound emission performance of the speaker 100.

As shown in FIGS. 2 and 7, the second inner edge 113b1 and the second outer edge 113b2 are coplanar. The suspension portion 113b3 is a structure formed by recessing from a plane of the second inner edge 113b1 in a direction facing away from the first diaphragm 111.

As shown in FIGS. 2 and 6, the first inner edge 113a1 is coplanar with the first outer edge 113a2. The projection of the beam 113a3 on a plane of the first inner edge 113a1 is in a linear shape, a C shape, or an S shape. Further, the projection of the beam 113a3 on a plane of the first inner edge 113a1 may also have other shapes, which may be designed according to specific use conditions.

As shown in FIGS. 2 and 6, in order to further effectively solve the pure tone problem caused by mutual impact of the suspension portion 113b3 and the beam 113a3 when the existing product is vibrated so as to improve the sound emission performance of the speaker, the flexible circuit board 113a may be provided with a plurality of beams 113a3, for example, two, three or other number of beams 113a3, which may be determined according to a specific use scenario.

As shown in FIGS. 2 and 6, the number of the elastic support members 113 is two, and the two elastic support members 113 are symmetrically arranged. In an example, as shown in FIG. 1, two elastic support members 113 may be symmetrically arranged on two sides of a long axis of the speaker 100.

Figure 3:
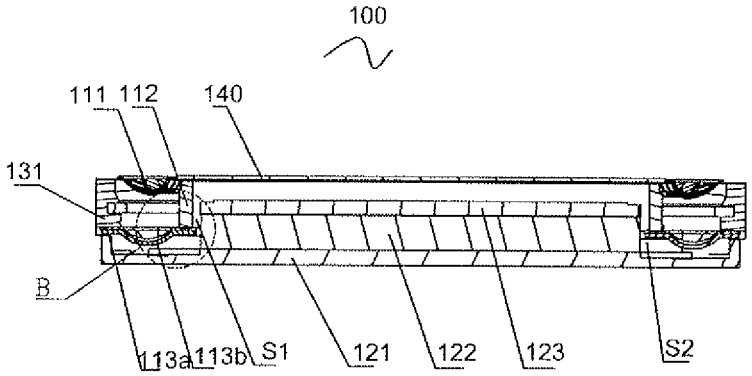
FIG. 3 is a cross-sectional view of the speaker shown in FIG. 1 taken along line AA.
Figure 4:
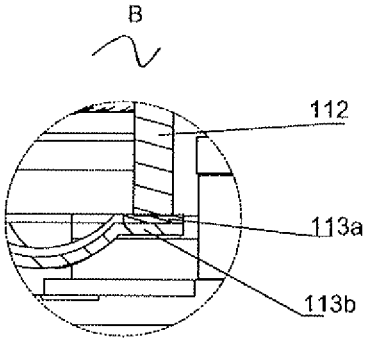
FIG. 4 is an enlarged view of portion B in FIG. 3.

In addition, as shown in FIGS. 2 and 3, the magnetic circuit unit 120 includes a lower splint 121, a main magnet 122, a pole plate 123, and an auxiliary magnet 124. The lower splint 121 is connected to the holder 131. The main magnet 122 and the pole plate 123 are sequentially arranged on the lower splint 121. The auxiliary magnet 124 is symmetrically arranged on two sides of the main magnet 122. A magnetic gap S1 is formed between the auxiliary magnet 124 and the main magnet 122. The voice coil 112 is inserted into the magnetic gap S1. The lower splint 121 and the holder 131 together enclose a receiving space S2 for receiving the vibration unit 110 and the magnetic circuit unit 120. In addition, the housing 130 further includes an upper splint 132 arranged at a side of the auxiliary magnet 124 facing away from the lower splint 121, that is, the auxiliary magnet 124 is sandwiched between the upper splint 132 and the lower splint 121. The upper splint 132 is fixed to the holder 131.

In addition, as shown in FIGS. 2 and 3, the speaker 100 may further include a structure such as a dome 140 covering the first diaphragm 111.

Figure 8:
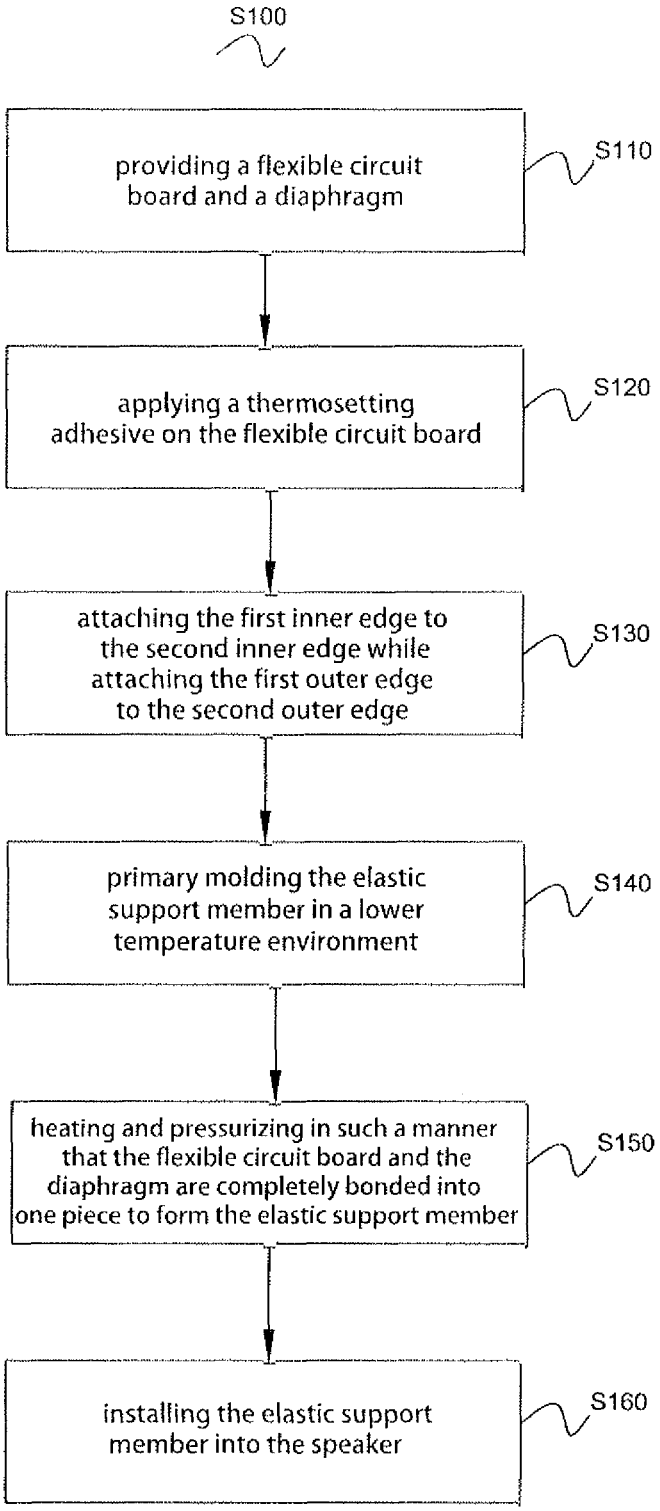
FIG. 8 is a flow chart showing a method for manufacturing an elastic support member according to an embodiment of the present disclosure.

As shown in FIG. 8, a second aspect of the present disclosure provides a method S100 for manufacturing the speaker as described above, including the following steps.

At step S110, a flexible circuit board and a diaphragm are provided.

Figure 5:
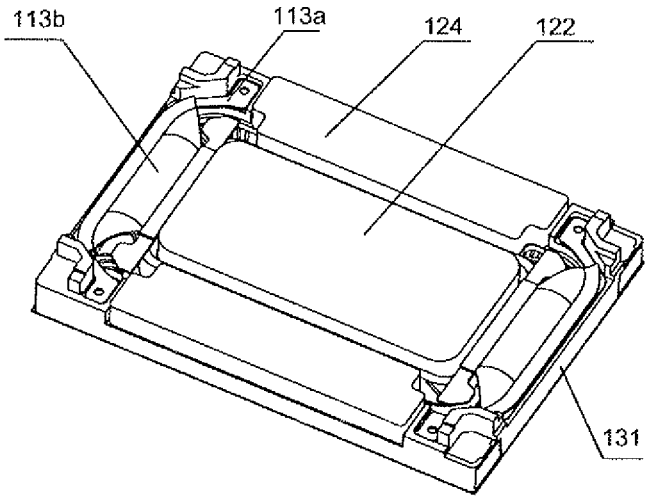
FIG. 5 is a schematic structural diagram according to an embodiment of the present disclosure when removing a speaker.

In one embodiment, for the structure of the flexible circuit board provided in this step, reference can be referred to FIG. 5. The flexible circuit board 113a includes a first inner edge 113a1, a first outer edge 113a2, and a beam 113a3. The beam 113a3 connects the first inner edge 113a1 with the first outer edge 113a2. The first outer edge 113a2 and the first inner edge 113a1 are coplanar. For the specific structure of the provided diaphragm, reference can be referred to FIG. 1. The diaphragm is the structure of the second diaphragm shown in FIG. 6, which includes a second inner edge 113b1, a second outer edge 113b2, and a suspension portion 113b3. The suspension portion 113b3 connects the second inner edge 113b1 with the second outer edge 113b2. The second inner edge 113b1 and the second outer edge 113b2 are coplanar. The suspension portion 113b3 is formed by recessing from a plane of the second inner edge 113b1 in a direction facing away from the first diaphragm 111.

At step S120, a thermosetting adhesive is applied on the flexible circuit board.

In an example, in this step, the thermosetting adhesive can be applied on the flexible circuit board in a manual or machine manner.

At step S130, the first inner edge is attached to the second inner edge, while the first outer edge is attached to the second outer edge.

At step S140, the elastic support member is initially molded in a low temperature environment.

In an example, in this step, the used low temperature may be determined according to actual requirements. For example, the elastic support member may be initially formed at an ambient temperature of 110° C.-120° C.'. The elastic support member may be initially formed at other ambient temperatures.

At step S150, heating and pressurizing is performed, so that the flexible circuit board and the diaphragm are completely bonded together to form the elastic support member 113.

At step S160, the elastic support member is installed into the speaker.

In one embodiment, the elastic support member 113 is fixed to the holder 131. One side of the flexible circuit board 113a is connected and fixed to the voice coil 112.

In one embodiment, in this step, the flexible circuit board and the diaphragm may be completely bonded together to form the elastic support member at an ambient temperature of 160° C.–180° C. The flexible circuit board and the diaphragm may be completely bonded together to form the elastic support member at other temperatures according to actual requirements. However, the ambient temperature used in this step should be greater than the ambient temperature in step S140.

In the manufacturing method S100 of the elastic support member in this embodiment, the flexible circuit board is attached and fixed to the second diaphragm by a thermosetting adhesive into one piece. Therefore, when a height of the speaker is constant, the vibration space of the second diaphragm can be saved, the Xmax range of the product can be improved, and the assembly processes can be reduced while the pure tone yield of the product can be improved.

The above are only preferred embodiments of the present disclosure. Here, it should be noted that those skilled in the art can make modifications without departing from the inventive concept of the present disclosure, but these shall fall into the protection scope of the present disclosure.

What is claimed is:

1. A speaker, comprising:

a vibration unit;

a magnetic circuit unit; and a housing for receiving the vibration unit and the magnetic circuit unit, wherein the vibration unit comprises:

a first diaphragm fixed to the housing;

a voice coil arranged under the first diaphragm to drive the first diaphragm to vibrate and emit sound; and two elastic support members arranged symmetrically under the voice coil, fixed to the housing and elastically supporting the voice coil, each of the elastic support members comprising a flexible circuit board connected to the voice coil and a second diaphragm fixed under the flexible circuit board, wherein the housing comprises a holder, the elastic support member is fixed to the holder, and the flexible circuit board is completely attached and fixed to the second diaphragm;

the flexible circuit board comprises a first inner edge glued to the voice coil, a first outer edge glued to the holder, and a plurality of beams connecting the first inner edge with the first outer edge;

the second diaphragm comprises a second inner edge attached and fixed to the first inner edge, a second outer edge attached and fixed to the first outer edge, and a suspension portion connecting the second inner edge with the second outer edge, the suspension portion being attached and fixed to the beams.

2. The speaker as described in claim 1, wherein the flexible circuit board and the second diaphragm are attached into one piece by a thermosetting adhesive.

3. The speaker as described in claim 2, wherein the second inner edge and the second outer edge are coplanar, and the suspension portion has a structure formed by recessing from a plane of the second inner edge in a direction facing away from the first diaphragm.

4. The speaker as described in claim 2, wherein the first inner edge is coplanar with the first outer edge, a projection of the beam on a plane of the first inner edge is in a linear shape, a C shape or an S shape.

5. A method for manufacturing the speaker as described in claim 1, comprising:

step S110 of providing a flexible circuit board and a diaphragm, wherein the flexible circuit board comprises a first inner edge, a first outer edge and a beam connecting the first inner edge with the first outer edge, the first outer edge is coplanar with the first inner edge, a projection of the beam on a plane of the first inner edge is in a linear shape, a C shape or an S shape; the diaphragm comprises a second inner edge, a second outer edge and a suspension portion connecting the second inner edge with the second outer edge, the second inner edge is coplanar with the second outer edge, the suspension portion has a structure formed by recessing from a plane of the second inner edge in a direction facing away from the first diaphragm;

Step S120 of applying a thermosetting adhesive on the flexible circuit board;

Step S130 of attaching the first inner edge to the second inner edge while attaching the first outer edge to the second outer edge;

Step S140 of primary molding the elastic support member in a low temperature environment;

Step S150 of heating and pressurizing in such a manner that the flexible circuit board and the diaphragm are completely bonded into one piece to form the elastic support member; and Step S160 of installing the elastic support member into the speaker.

6. The method for manufacturing a speaker as described in claim 5, wherein an ambient temperature in the step S140 is 110° C. to 120° C., and an ambient temperature in the step S150 is 160° C. to 180° C.

* * * * *